US005458776A

United States Patent [19]

Preisser et al.

[11] Patent Number: 5,458,776

[45] Date of Patent: Oct. 17, 1995

[54] SAND DEWATERING CENTRIGUSE

[75] Inventors: Mark A. Preisser; Steinar Storruste, both of Haven, Kans.

[73] Assignee: Haahjem North American, Inc., Salina, Kans.

[21] Appl. No.: 170,745

[22] Filed: Dec. 21, 1993

[51] Int. Cl.[6] ..... B04B 1/00

[52] U.S. Cl. ..... 210/378; 210/360.1; 210/379; 210/380.1; 210/381; 49/27; 49/28; 49/29

[58] Field of Search ..... 210/787, 360.1, 210/377, 378, 379, 380.1, 381; 494/27–29

[56] References Cited

U.S. PATENT DOCUMENTS

| | | | |
|---|---|---|---|
| 46,030 | 1/1865 | Sellers . | |
| 1,153,367 | 9/1915 | Armstrong | 210/378 |
| 2,312,829 | 3/1943 | Bird . | |
| 2,422,464 | 6/1947 | Bartholomew . | |
| 2,695,133 | 11/1954 | Drury | 210/378 |
| 2,782,930 | 2/1957 | Heckmann . | |
| 4,066,547 | 1/1978 | Hoks . | |
| 4,608,040 | 8/1986 | Knelson | 494/29 |
| 4,616,786 | 10/1986 | Riker . | |

FOREIGN PATENT DOCUMENTS 957929 9/1982 U.S.S.R. .

*Primary Examiner*—Robert A. Dawson

*Assistant Examiner*—David Reifsnyder

*Attorney, Agent, or Firm*—Richard C. Litman

[57] ABSTRACT

A centrifuge for dewatering a fluent aggregate material such as sand. Sand slurry is conducted into a rotating cylindrical drum which has a perforated lateral wall against which a screen is placed. The drum is oriented with the axis disposed vertically. When the centrifuge operates, centrifugal action slings slurry poured into the drum outwardly. Upon contacting the lateral wall, the slurry builds up. When a certain quantity of the slurry has built up at the bottom or floor of the cylinder, additional material cannot resist migrating upwardly. Thickness of the trapped layer varies, being greater at the floor, near the source of the incoming slurry. This trapped layer forms a bed having an inclined wall. Thickness of the bed at the top of the cylinder is determined by a circumferential, inwardly projecting flange or dam located at the top of the cylindrical drum. The sand bed protects metal parts of the centrifuge from abrasion, and also enables water to diffuse therethrough. Water is discharged through perforations in the lateral wall, and dewatered sand continues to migrate upwardly. At the top of the drum, this sand migrates beyond the flange, and is slung outwardly against a shroud, which directs the sand to an outer conveyor or chute therebelow. This shroud includes an internal shelf which traps a layer of sand protecting the shroud from erosion by sand ejected from the drum. Water is trapped by a second shroud, and is collected at a suitable discharge chute or conduit.

14 Claims, 1 Drawing Sheet

SAND DEWATERING CENTRIGUSE

BACKGROUND OF THE INVENTION

1. Field of the Invention

The present invention relates to a centrifuge for substantially separating solid and liquid components of a slurry.

2. Description of the Prior Art

Crushed aggregate materials, such as sand or slag, and other materials which are handled as slurries, such as plant pulps, must be dewatered prior to subsequent handling in many applications. Centrifugal dewatering apparatus has long been employed in such capacity.

Typical centrifuges have frustoconical drums wherein the rotational axis is vertical. An early example of such a centrifugal separator is seen in U.S. Pat. No. 46,030, issued to George E. Sellers on Jan. 24, 1865.

A slurry is typically fed to the centrifuge through a conduit from above, the conduit discharging toward the center of the floor of the drum. U.S. Pat. No. 2,312,829, issued to Byron M. Bird et al. on Mar. 2, 1943, discloses a coal slurry separator having such a conduit. The Bird et al. patent further illustrates respective shrouds for collecting liquid and aggregate.

Further examples of centrifugal separators are seen in U.S. Pat. Nos. 2,422,464, issued to Tracy Bartholomew on Jun. 17, 1947, and 2,782,930, issued to Wolfgang G. J. Heckman on Feb. 26, 1957, and 4,066,547, issued to Dirk Hoks on Jan. 3, 1978.

A cylindrical drum is seen in U.S. Pat. No. 4,616,786, issued to Rudolf Riker on Oct. 14, 1986 and directed to separation of unhardened concrete into its constituent parts. However, this arrangement involves simple immersion in water and does not employ centrifugal action to effect separation.

In Soviet Pat. No. 957,929, dated Sep. 15, 1982, a centrifugal separator includes a frustoconical rotating drum which, unlike those of the above mentioned patents, does not have a greater diameter at the top than at the bottom. However, operation differs significantly from the present invention in other respects.

None of the above inventions and patents, taken either singly or in combination, is seen to describe the instant invention as claimed.

SUMMARY OF THE INVENTION

The present invention finds advantageous application in sand quarries and similar facilities, wherein sand is handled in large quantities. The novel dewatering centrifuge processes more sand, and at lower cost, than is processed by conventional recovery equipment.

By its nature, the novel dewatering centrifuge is self-protecting from abrasion and attendant wear. A rotating drum has a vertical wall and an inwardly projecting flange, unlike those of the prior art. Sand from a slurry discharged into the drum builds up a covering layer of sand on the vertical wall. The resultant sand bed provides a porous medium through which water diffuses under the influence of centrifugal force. Dewatered sand migrates upwardly, eventually discharging from the drum for retention by a shroud. Unlike prior art centrifuges, which would possibly be subject to abrasion and considerable wear brought about by such migration, the sand bed protects the metal vertical wall, as well as forming an inclined surface promoting upward migrating of sand fed into the centrifuge. Thickness of the sand bed is determined by the width of the internal flange formed at the top of the cylindrical drum.

Two shrouds collect and separate ejected solids and liquids. The shroud collecting the solids fraction of the slurry enjoys the same self-protective feature found in the drum. To this end, a shelf is located inside the sand collecting shroud, on which builds up a protective layer of sand similar to that of the drum. The shroud is thus spared wear from constant bombardment by ejected sand particles.

A screen placed just inside the perforated, vertical wall of the drum. This screen has interstitial spaces promoting propogation of separated liquid towards perforations formed in the circumferential wall. Thus, liquid which flows through the sand bed is not hindered during ejection from the perforations.

Another important feature is the conical floor of the drum. This conical floor, which preferably extends into the conduit delivering fresh slurry into the drum, serves as a distributor which distributes incoming slurry evenly about the circumference of the drum. This is important in preventing unbalanced loading of the drum, which could severely damage or shorten the life of the centrifuge, given the high possible rotational speeds of the drum. It also prevents clogging of the mouth of the slurry supply conduit by expeditiously directing slurry to the circumference of the drum.

Because slurry is continuously accepted, separated, and discharged in constituent streams, the centrifuge is capable of prolonged constant operation. It may be operated at fairly high speed without slinging unprocessed slurry therefrom.

Because it relies on ordinary centrifugal action, conventional components may be employed therein, such as motor and controls, drive belts, bearings, and the like. Cylindrical construction of the rotating drum enables the same to be constructed without resorting to forming patterns which must be carefully constructed to produce a specific, predetermined frustoconical shape during and after assembly.

Accordingly, it is a principal object of the invention to provide a sand dewatering centrifuge which is self-protected from abrasion and wear.

It is another important object of the invention to provide a sand dewatering centrifuge which expeditiously distributes incoming slurry to the circumference of the drum.

It is a further object of the invention to provide a sand dewatering centrifuge which has a vertical outward wall.

Yet another object of the invention is to provide a sand dewatering centrifuge which has a cylindrical, rather than conical, rotating drum.

Still another object of the invention is to provide a sand dewatering centrifuge which causes the subject process medium to provide a protective lining thereto.

An additional object of the invention is to provide a sand dewatering centrifuge having an internal flange opposing unrestricted upward migration of the subject process medium therein.

A still further object of the invention is to provide a dewatering centrifuge which expeditiously directs separated water to holes enabling ejection from the centrifuge drum.

Another object of the invention is to provide a dewatering centrifuge which operates continuously at high rotational speeds.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
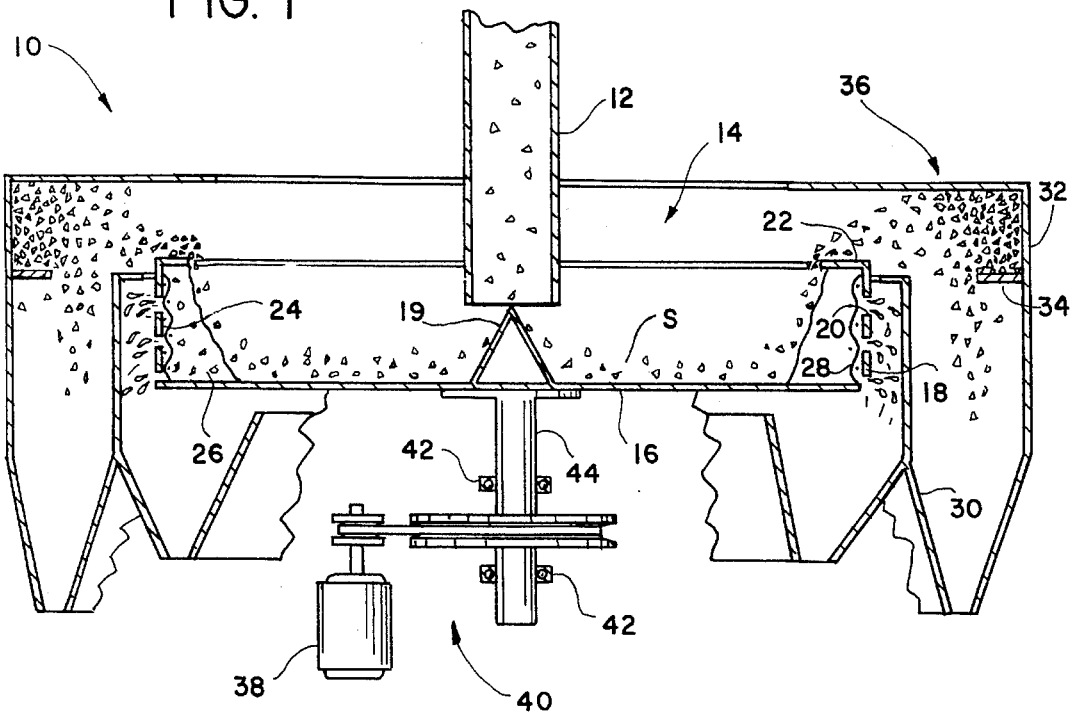
FIG. 1 is a diagrammatic, partly cross sectional detail view of the principal components of the novel dewatering centrifuge, partly broken away for clarity.

Turning now to FIG. 1 of the drawings, the novel dewatering centrifuge 10 is shown in operation. Slurry S is poured into centrifuge 10 through a supply conduit 12, which, in alternative embodiments, is part of centrifuge 10, or is part of other equipment (not shown).

A rotating cylindrical drum 14 receives slurry S, which is slung outwardly. Drum 14 has a floor 16 and an outer, vertical wall 18. Floor 16 includes a conical distributor 19, which preferably projects into conduit 12. Distributor 19 expeditiously directs slurry to outer wall 18. This avoids clogging the opening of conduit 12, and, more importantly, causes slurry S to be distributed evenly about various points along outer wall 18. Experience has shown that wet sand slurries can form clumps, which frequently cause the slurry to be distributed unevenly against an outer drum surface in the absence of a distributor. Since drum 14 is rotated at considerable speed, and the radius of drum 14 is substantial, a potentially catastrophic unbalanced condition is thus avoided.

Figure 5:
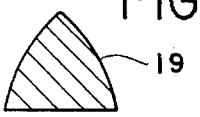
FIGS. 4 and 5 are cross sectional views of alternative embodiments of a component of the centrifuge, taken from, approximately, the center of FIG. 1.
Figure 4:
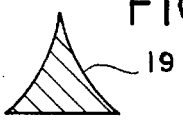

While distributor 19 is preferably conical, other configurations would also be effective. As seen in FIGS. 4 and 5, distributor 19 could have a curved control profile, as well as still other configurations, provided that it is has an inclined surface directing slurry radially outwardly, to outer wall 18.

Outer wall 18 includes perforations 20 for discharging the liquid fraction of the slurry from drum 14. Outer wall 18 terminates at an upper, circumferential edge 21, at which point an inwardly projecting flange 22 is disposed. This flange 22 enables a self-protecting feature to come into play as follows. The self-protecting feature is particularly advantageous in dewatering a slurry having an abrasive solids fraction, such as sand and water slurry. This situation is frequently encountered at facilities producing sand and gravel from geological deposits. Slurry S flows into drum 14 and is slung outwardly against outer wall 18. As slurry builds up against the interior surface 24 of outer wall 18, centrifugal force causes slurry S and separated solids to migrate upwardly. As this occurs, a bed 26 of solids is progressively formed.

This bed 26 is trapped against outer wall 18 between floor 16 and flange 22, and remains in place continuously as long as drum 14 is rotating. Bed 26 comprises a water permeable, sand impermeable medium which both prevents passage of additional sand, yet passes water to the outer wall 18. Additional sand migrates upwardly, clearing drum 14 and is slung outwardly under influence of centrifugal force.

A screen 28 is placed between outer wall 18 and bed 26. Screen 28 enables water to be accepted from the entire outer, circumferential area of bed 26, providing an unobstructed passageway through its interstitial spaces to the nearest perforation 20. This enables drum 14 to shed separated water at a rate commensurate with input of fresh slurry to drum 14. Thus, efficiency of dewatering centrifuge 10 is improved, while not requiring a large number of perforations 20, which would increase costs and reduce strength of outer wall 18.

Another important benefit arising from this arrangement is that bed 26 protects outer wall 18 from wear due to abrasion by migrating sand. Freshly introduced sand contacts only sand in bed 26, and outer wall 18 is thus spared abrasion. For this reason, while floor 16 is made from a material selected for resistance to abrasion, outer wall 18 need not be so fabricated. It is desirable to employ a less expensive material in manufacturing a part which is subject to several fabrication steps, such as forming in a circular configuration, and punching perforations therein. It is also economically advantageous to employ the material being processed to provide the protective layer afforded by bed 26.

As is seen in this drawing figure, water is ejected from drum 14 at outer wall 18. A shroud 30 surrounds drum 14, and extending almost to and terminating below circumferential edge 21. Water slung from drum 14 is collected in shroud 30, and is conducted to any suitable point for subsequent discharge or storage.

Another shroud 32 surrounds drum 14 and shroud 30, extending well above the former. Solids which migrate to the top of drum 14 and past flange 22 are retained in shroud 32, which conducts the solid to a chute, conveyor or the like, maintaining the solids fraction of the original slurry separated from the liquid fraction thereof.

Shroud 32 is protected from bombardment by sand particles in much the same manner as outer wall 18 of drum 14. An inwardly projecting, horizontal shelf 34 is attached to shroud 32, and sand quickly builds up a protective layer 36. This layer 36 is retained by shelf 34, and sand not forming a portion of layer 36 falls downwardly, is collected within shroud 32 and is conducted to any suitable point for subsequent discharge or storage.

Dewatering centrifuge 10 is powered by an electric motor 38, connected thereto by a drive 40. In the present example, drive 40 comprises an arrangement of belt and aligned sheaves. Drive 40 may be of another type, such as a well known hydraulic drive (not shown), or may include such speed controls as a variable frequency controller (not shown). Bearings 42 secure a drive shaft 44 to a frame (see FIG. 2). Bearings 42 are shown diagrammatically, and of course will be arranged to bear both radial and thrust loads.

Figure 2:
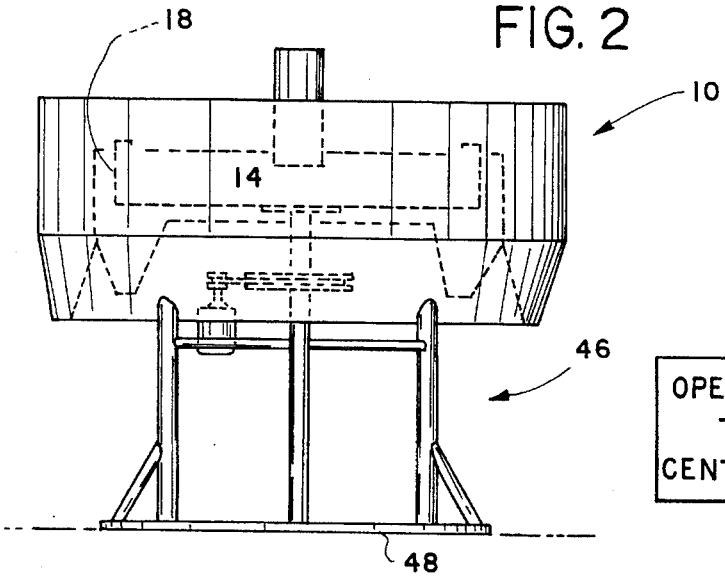
FIG. 2 is a side elevational view of the novel dewatering centrifuge, drawn to reduced scale.

FIG. 2 illustrates a suitable frame 46 which includes a stable base 48. It will be noted, particularly by examination of FIG. 1, that drum 14 has a generally flat cylindrical configuration. This geometry contributes to efficient processing, in that the relatively great radius results in high angular velocity at outer wall 18, which, in turn, rapidly ejects water from slurry. Also, the overall area of outer wall 18 is substantial, while minimizing the overall height dimension of dewatering centrifuge 10, which limits size, weight, and anchoring requirements of base 48.

Figure 3:
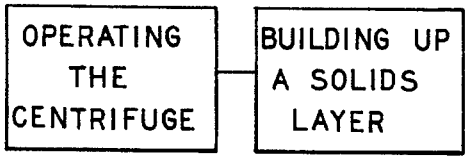
FIG. 3 is a block diagram of the steps of a method of operating a dewatering centrifuge to achieve the benefits inhering in the present invention.

The apparatus described above illustrates one approach to achieve efficient processing while protecting much of the centrifuge from abrasion. An important step in the process providing this element of self-protection of drum 14 includes entrapping a layer or bed 26 of solids against a vulnerable surface of centrifuge 10, such as outer wall 18 and/or shroud 32, in the course of operating centrifuge 10. The step of building up bed 26 is completed shortly after initiating operation of the centrifuge, and dewatering processing is accomplished only after this step has been accomplished. This method is summarized in the steps shown in FIG. 3, reading left to right. Dewatering centrifuge 10 may then be operated on a prolonged basis, continuously dewatering slurry and producing dewatered sand.

It is to be understood that the present invention is not limited to the embodiments described above, but encompasses any and all embodiments within the scope of the following claims.

We claim:

1. A dewatering centrifuge for separating a sand slurry having an aqueous liquid fraction and a fluent solids fraction containing sand, said dewatering centrifuge comprising;

a rotating flattened drum having a non-rotating, substantially closed and horizontal top wall adjacent and spaced from a vertical rotating outer wall having openings therein for passage of an aqueous liquid fraction under the influence of centrifugal force;

said drum having an upper circumferential edge which has an inwardly projecting flange, whereby a sand containing fraction is constrained against migrating further through said outer wall's openings and accumulates against said outer vertical wall, thus forming a self-protective bed;

a central aperture in said substantially closed and horizontal top wall contiguous to a non-rotating vertical feed pipe for admitting said slurry thereinto;

a substantially flat floor closing and sealing a lower end of said rotating drum; and said rotating drum causing said slurry free to travel an unobstructed path of least resistance towards said vertical outer wall and to separate into an aqueous liquid fraction passing through said vertical outer wall and a fluent solids fraction containing sand passing through the space between the top wall and said flange.

2. The dewatering centrifuge according to claim 1, further including a stationary aqueous liquid fraction collecting shroud which partially surrounds said rotating drum circumferentially, said shroud collecting the aqueous liquid fraction of the slurry discharged radially from said drum by centrifugal action, and separating the aqueous liquid fraction from the fluent solids fraction of the slurry containing sand.

3. The dewatering centrifuge according to claim 1, further including a stationary solids fraction collecting shroud surrounding and extending above said drum said shroud collecting the fluent solids fraction containing sand of the slurry, as the fluent solids fraction containing sand escapes from said drum under the influence of centrifugal force, and separating the fluent solids fraction containing sand from the aqueous liquid fraction of the slurry.

4. The dewatering centrifuge according to claim 3, said stationary solids collecting shroud further including an inwardly projecting, horizontal shelf formed therewith, for retaining a layer of the solids fraction containing sand ejected from said drum, said layer of the solids fraction containing sand protecting said solids collecting shroud from bombardment by particles of a solids fraction containing sand subsequently ejected from said drum.

5. The dewatering centrifuge according to claim 1, further including a motor and drive means connecting said motor to said drum.

6. The dewatering centrifuge according to claim 1, further including a continuously liquid permeable and continuously fluent solids impermeable screen disposed within and against said rotating vertical outer wall, said screen having interstitial spaces therein conducting an aqueous liquid fraction separated from the slurry to openings in said outer wall under centrifugal force.

7. The dewatering centrifuge according to claim 1, said floor further including a distributor for directing slurry delivered from above outwardly to said outer wall.

8. The dewatering centrifuge according to claim 7, wherein said distributor has a curved conical profile.

9. A dewatering centrifuge for separating a slurry having an aqueous liquid fraction and a fluent solids fraction, said dewatering centrifuge comprising;

a flattened cylindrical rotating drum consisting essentially of a stationary, substantially closed and horizontal top wall adjacent and spaced from a vertical outer wall having openings therein for passage of the aqueous liquid fraction under the influence of centrifugal force;

a central aperture in said substantially closed and horizontal top wall contiguous to a stationary vertical feed pipe for admitting said slurry thereinto;

a substantially flat floor closing and sealing a lower end of said cylindrical rotating drum, said floor including a conical distributor for distributing incoming slurry to said vertical, outer wall;

said drum having an upper circumferential edge which has an inwardly projecting flange, and a screen disposed within and against said vertical outer wall to permit only the aqueous liquid fraction to pass, whereby the solids fraction is separated from the aqueous liquid fraction of the slurry.

10. The dewatering centrifuge according to claim 9, further including:

a first shroud partially circumferentially surrounding said drum, and a second shroud surrounding said drum and extending thereabove, said first shroud collecting the liquid fraction of the slurry and said second shroud collecting the fluent solids fraction of the slurry.

11. The dewatering centrifuge according to claim 10, said second shroud further including an inwardly projecting, horizontal shelf formed therewith, said shelf retaining a layer of solids thereabove when said dewatering centrifuge is operating, for protecting said second shroud from bombardment by particles of solid ejected from said drum.

12. The dewatering centrifuge according to claim 11, further including a motor and drive means connecting said motor to said drum.

13. A dewatering centrifuge for separating a slurry having a liquid fraction and a fluent solids fraction, said dewatering centrifuge comprising:

a cylindrical rotating drum having an outer wall having means defining at least one opening therein for escape of the liquid fraction under the influence of centrifugal force, an open upper end, a floor closing and sealing a lower end of said cylindrical rotating drum, said floor including a distributor for directing incoming slurry to said vertical, outer wall;

an upper circumferential edge, and an inwardly projecting flange disposed at said upper circumferential edge;

a first shroud partially circumferentially surrounding said drum;

a second shroud surrounding said drum and extending thereabove, said second shroud further including an inwardly projecting, horizontal shelf formed therewith, said shelf retaining a layer of the solids fraction thereabove when said dewatering centrifuge is operating, for protecting said second shroud from bombardment by particles of the solids fraction ejected from said drum; and a motor and drive means connecting said motor to said drum.

14. The dewatering centrifuge according to claim 13, further including a continuously liquid permeable, continuously fluent solids impermeable member disposed within and against said vertical outer wall.

* * * * *